US006698418B2

(12) United States Patent
Ramsey et al.

(10) Patent No.: US 6,698,418 B2
(45) Date of Patent: Mar. 2, 2004

(54) OVEN DOOR LATCH ASSEMBLY HAVING SIDE MOUNTED MOTOR

(75) Inventors: James Ramsey, Murfreesboro, TN (US); Donald E. Smith, Smithville, TN (US); Robert G. Sokalski, Murfreesboro, TN (US)

(73) Assignee: France/A Scott Fetzer Company, Fairview, TN (US)

( * ) Notice: Subject to any disclaimer, the term of this patent is extended or adjusted under 35 U.S.C. 154(b) by 143 days.

(21) Appl. No.: 10/023,917

(22) Filed: Dec. 17, 2001

(65) Prior Publication Data

US 2003/0041852 A1 Mar. 6, 2003

Related U.S. Application Data

(60) Provisional application No. 60/315,498, filed on Aug. 28, 2001.

(51) Int. Cl.[7] ..... F24C 15/04

(52) U.S. Cl. ..... 126/197; 126/19 R; 219/398; 292/DIG. 69

(58) Field of Search ..... 126/197, 19 R, 126/192; 219/398; 292/DIG. 69, 109, 111, 114

(56) References Cited

U.S. PATENT DOCUMENTS

| | | | | |
|---|---|---|---|---|
| 3,313,918 A | | 4/1967 | Barber | |
| 3,462,584 A | | 8/1969 | Guy | |
| 3,476,424 A | * | 11/1969 | Erickson | 292/66 |
| RE27,545 E | | 1/1973 | Guy | |
| 3,859,979 A | | 1/1975 | Gilliom | |
| 3,875,372 A | | 4/1975 | Gilliom | |
| 3,889,654 A | | 6/1975 | Kauranen et al. | |
| 4,082,078 A | | 4/1978 | Thuleen et al. | |
| 4,109,637 A | | 8/1978 | Drouin | |
| 4,374,320 A | | 2/1983 | Barnett | |
| 4,927,996 A | | 5/1990 | Genbauffe et al. | |
| 5,029,910 A | | 7/1991 | Genbauffe et al. | |
| 5,220,153 A | | 6/1993 | Malone et al. | |
| 5,440,103 A | * | 8/1995 | Martin | 219/413 |
| 5,477,030 A | * | 12/1995 | Buckshaw et al. | 219/413 |
| 5,493,099 A | * | 2/1996 | McWilliams, III | 219/413 |
| 6,079,756 A | | 6/2000 | Phillips | |
| 6,315,336 B1 | * | 11/2001 | Swartzell | 292/201 |
| 6,474,702 B1 | * | 11/2002 | Malone et al. | 292/97 |

OTHER PUBLICATIONS

Four photograph copies of range lock manufactured and sold by Summit Mfg. Co. Inc., 739 N. Mountain Rd., Newington, CT, 06111.

* cited by examiner

*Primary Examiner*—Alfred Basichas
(74) *Attorney, Agent, or Firm*—Wood, Herron & Evans, L.L.P.

(57) ABSTRACT

A motorized door latch assembly for locking an oven door in a locked and sealed position for purposes of cleaning the oven. A motor and cam cause a latch rod extending from side to side to translate, causing a latch plate to move between three different positions. In one position the latch plate prevents the oven door from opening. From this position, the latch plate is pulled inwardly, orthogonal to the direction of motion of the latch rod, so the oven door is in a locked and sealed position. In its locked and sealed position the door may be opened by biasing the latch plate against the bias of a biaser extending between a fixed location on a mounting plate and a fixed location on the latch plate.

20 Claims, 4 Drawing Sheets

OVEN DOOR LATCH ASSEMBLY HAVING SIDE MOUNTED MOTOR

CROSS REFERENCE TO RELATED APPLICATIONS

This patent application claims priority to provisional patent application serial No. 60/315,498 filed Aug. 28, 2001 entitled "Oven Door Latch Assembly Having Side Mounted Motor" which is fully incorporated by reference herein.

FIELD OF THE INVENTION

This application relates to a motorized oven door latch assembly for locking an oven door in a closed position when the oven is in a self-cleaning mode.

BACKGROUND OF THE INVENTION

Self-cleaning ovens which are incorporated into self-standing ranges are well known. Such ovens conventionally have an oven door which is hingedly secured to a range body. The oven door may be opened to gain access to an oven cavity. The oven door may also be closed to close the opening for cooking objects placed in the cavity or cleaning the cavity. One or more heating elements reside in the oven cavity for cooking purposes.

Motorized latches which are used to lock oven doors in a closed position so that the oven cavity may be self cleaned are well known. U.S. Pat. No. 3,859,979 and U.S. Pat. No. RE. 27,545 and U.S. Pat. No. 4,374,320 all disclose such motorized self-cleaning oven door latches. Such oven door latches are activated by a rotary motor located at the rearward portion of the range above the oven. Activation of the motor causes a rod to translate which causes a latch at the front of the rod to engage the oven door so that the oven door may not be opened. After the cleaning has occurred, the motor is reactivated, causing the latch at the front of the rod to disengage the oven door so that the oven door may be opened.

One disadvantage with oven door latch assemblies having motors located rearwardly of the oven cavity is that the high temperatures required for oven cleaning may damage the motor and/or associated electrical components such as switches. Therefore, a need exists for an oven door latch assembly having a motor which is located such that its exposure to temperature is minimized. It has further been an objective of the present invention to provide an oven door latch which is driven by a motor located to the side of the oven cavity.

SUMMARY OF THE INVENTION

The invention of this application which accomplishes these objectives comprises a motorized door latch assembly for locking an oven door in a closed and sealed position so as to close an oven cavity for purposes of cleaning the oven cavity. The oven door is hingedly mounted on a range body and moveable between an open position, a closed position and a closed and sealed position.

The door latch assembly comprises a mounting plate supported by the range body beside the oven cavity and extending generally horizontally. Fixedly secured to the mounting plate is a driver such as a motor. The driver need not be fixedly secured to the mounting plate; it may be at any desired location. However, the driver or motor is preferably located beside the range or oven cavity to reduce the amount of heat to which the motor is exposed. The motor rotatively drives a cam, operatively associated with the motor.

A drive member or latch rod, having a pair of opposed ends, extends between the cam and an L-shaped link pivotally secured to the mounting plate. The latch rod has a first end secured to the rotatable cam and a second end secured to the L-shaped link. Rotation of the cam causes the latch rod to translate generally from side to side. Other devices, such as for example a solenoid, may be used to cause the latch rod to translate.

A latch plate, having a hook at one end for engaging the oven door, is secured to the L-shaped link at the other end. The latch plate has an opening therethrough capturing a pin that extends upwardly from the mounting plate. The size and configuration of the opening and location of the pin restrict the movement of the latch plate so as to move the latch plate between three desired positions.

In operation, rotation of the cam by activation of the motor causes the latch rod to translate generally from side to side and causes the latch plate to move between three positions: a first position, a second position and a third position. In the first position, the latch plate is located such that the oven door may be opened. Upon translation of the latch rod, the latch plate moves to a second position in which the hook of the latch plate engages the oven door to prevent the oven door from being opened. In the third position, the latch plate is pulled inwardly by the latch rod, pulling the oven door into a locked and sealed position. Notably, the direction of translation when the oven door is pulled into the locked and sealed position, is substantially nonparallel to the direction in which the latch rod is translated by the motor, through action of the L-shaped link.

A biaser extends between a fixed point on the mounting plate and the latch plate so as to bias the latch plate towards the second position described hereinabove. In the event of a failure while the oven is in a self-cleaning mode and the latch plate is in its third position, i.e. while the door is locked and sealed, a user, using a pry bar tool, may exert pressure on the hook of the latch plate causing the latch plate to rotate about the pin of the mounting plate toward the first position. With the latch plate pulled over to its first position the oven door may be opened without having to call a service technician and/or take the oven apart.

DETAILED DESCRIPTION OF THE DRAWINGS

Figure 1:
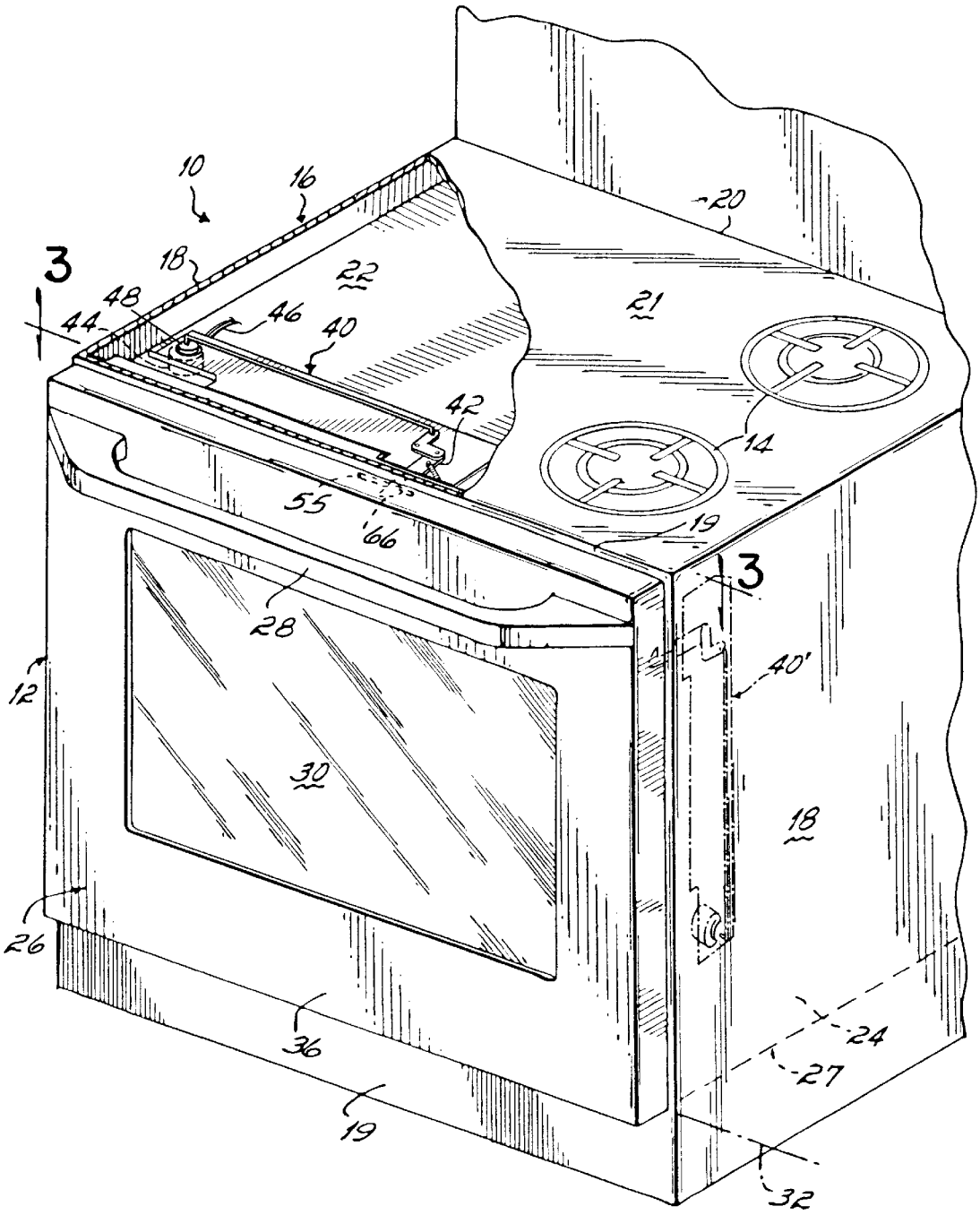
FIG. 1 is a perspective of a self-standing range with a portion cut away, with a latch built in accordance with the present invention.
Figure 2:
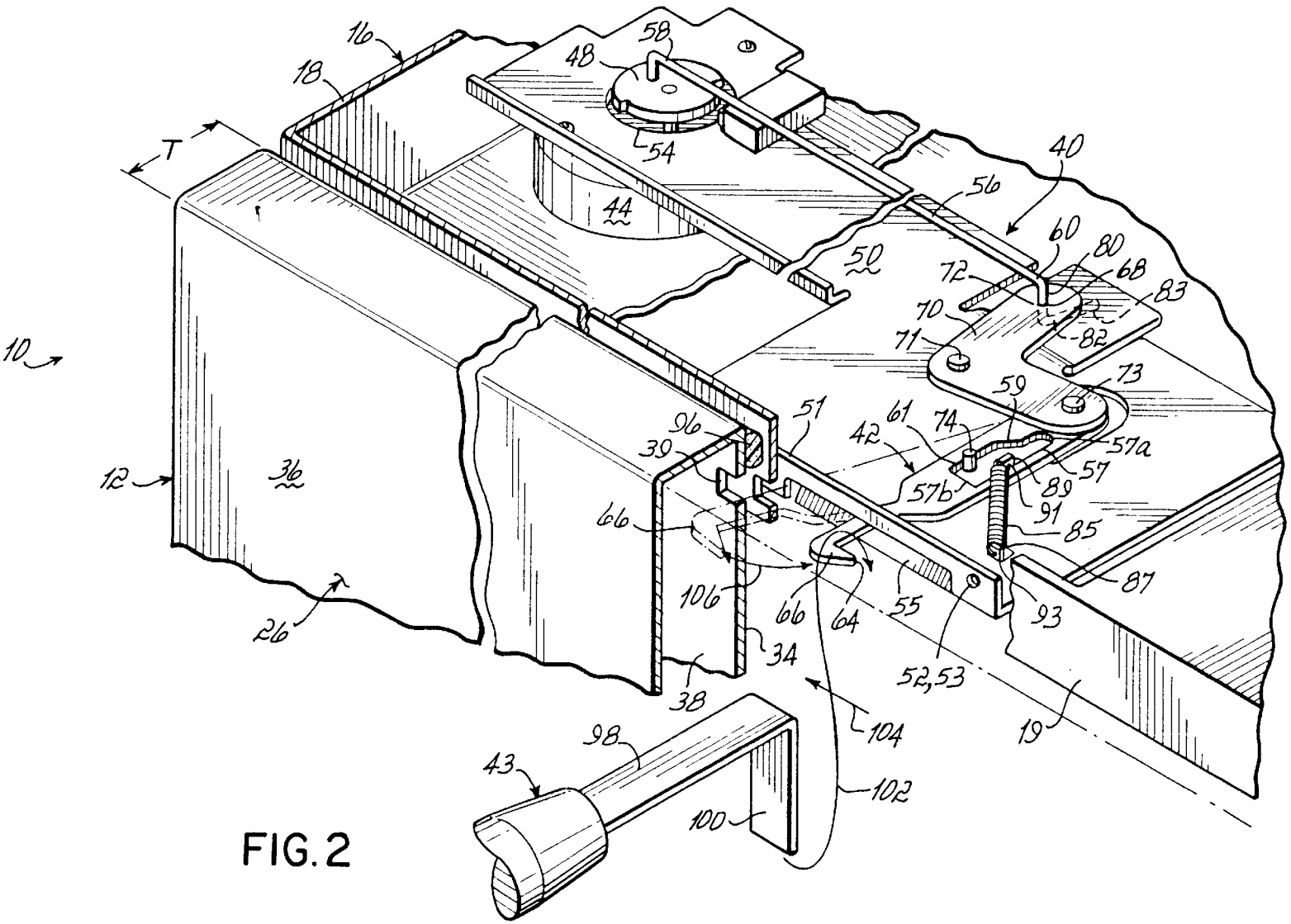
FIG. 2 is an enlarged view of a portion of the front edge of the range of FIG. 1 with a pry bar-type tool illustrated being used to open the oven door.

Referring to the drawings, and particularly to FIG. 1, there is illustrated a self-standing range 10 including a pyrolytic self-cleaning oven 12 on top of which are a plurality of burners 14 as is conventional. The range 10 comprises a range body 16 having a pair of side walls 18, a front wall 19, a back wall 20 (see FIG. 1) and a top 21. Spaced a fixed distance below the top 21 of the range body 16 is an oven top wall 22. An oven cavity 24 inside which resides one or more heating elements (not shown) is defined by the oven top wall 22, side walls 18 of the range body, a cavity back wall (not shown) and a bottom 27. An oven door 26 having a handle 28 and a window 30 is hingedly mounted to the front wall 19 of the range body so that a user pulling on the handle 28 will cause the oven door 26 to hingedly open about an horizontal axis 32 in order to move the door 26 between a closed position as shown in FIG. 1 and an open position. As best illustrated in FIG. 2, the oven door 26 has a thickness T defined between a back wall 34 and a front wall 36 between which is insulation 38.

Illustrated within range 10 above top wall 22 and below top 21 of the range body 16, is a latch assembly 40 mounted to the range body and/or the walls 21 and 22, and positioned to latch door 26 in a closed and sealed position by the action of the front end 66 of a latch plate 42. Further detail on the structure of assembly 40 and the interaction of latch plate 42 with oven door 26 will be provided below.

FIG. 1 illustrates that the latch assembly may be located in an alternative position 40' adjacent to either side wall 18 of the oven, in which case latch plate 42 engages to a side of oven door 26 in a similar manner. Note that in both the position illustrated in solid lines in FIG. 1, and in the alternative position 40' illustrated in FIG. 1, the latch rod 56 extending between the motor and latch plate moves along a direction that is roughly orthogonal to the direction in which the latch plate pulls the oven door when moving to the locked and sealed position. The structure of the latch assembly 40 facilitates this operation regardless of the position of that assembly within the oven.

While the latch assembly may be horizontally and vertically positioned as shown in FIG. 1, it may also be positioned in an angled orientation, in which case the direction of motion of the latch rod 56, while still substantially nonparallel to the direction of pull in of the latch plate, is not necessarily orthogonal to the direction of pull in. The structure of the latch assembly, as elaborated below, facilitates installations where there is a substantially nonparallel relationship between the direction of motion of the latch rod 56 and the pull in direction, such as at angles of greater than 30, 45 or 60 degrees.

It will be noted that in either the top-mounted position shown in FIG. 1, or in a side mounted position shown at 40' in FIG. 1, the position of the motor 44 within the latch assembly is to the side of the oven and thus somewhat removed from heat generated in the oven. The latch assembly, by permitting a nonparallel relationship between the direction of motion of the latch rod 56 and the pull-in direction, permits placement of the motor in a wide variety of locations so as to avoid the damaging effects of exposure to heat.

Figure 3:
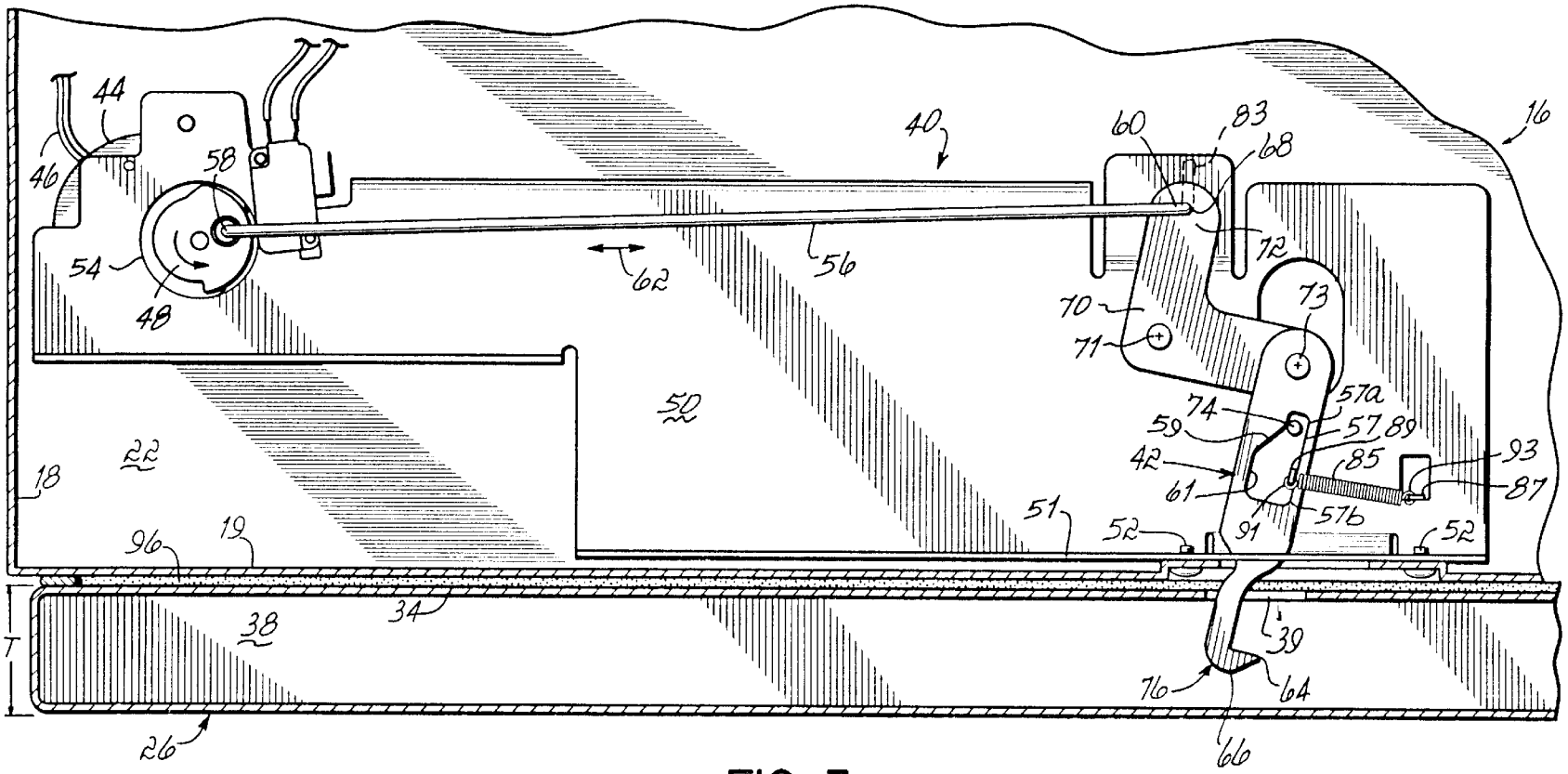
FIG. 3 is a top view of the motorized oven door latch assembly of the present invention, the latch plate being illustrated in an unlocked position.
Figure 4:
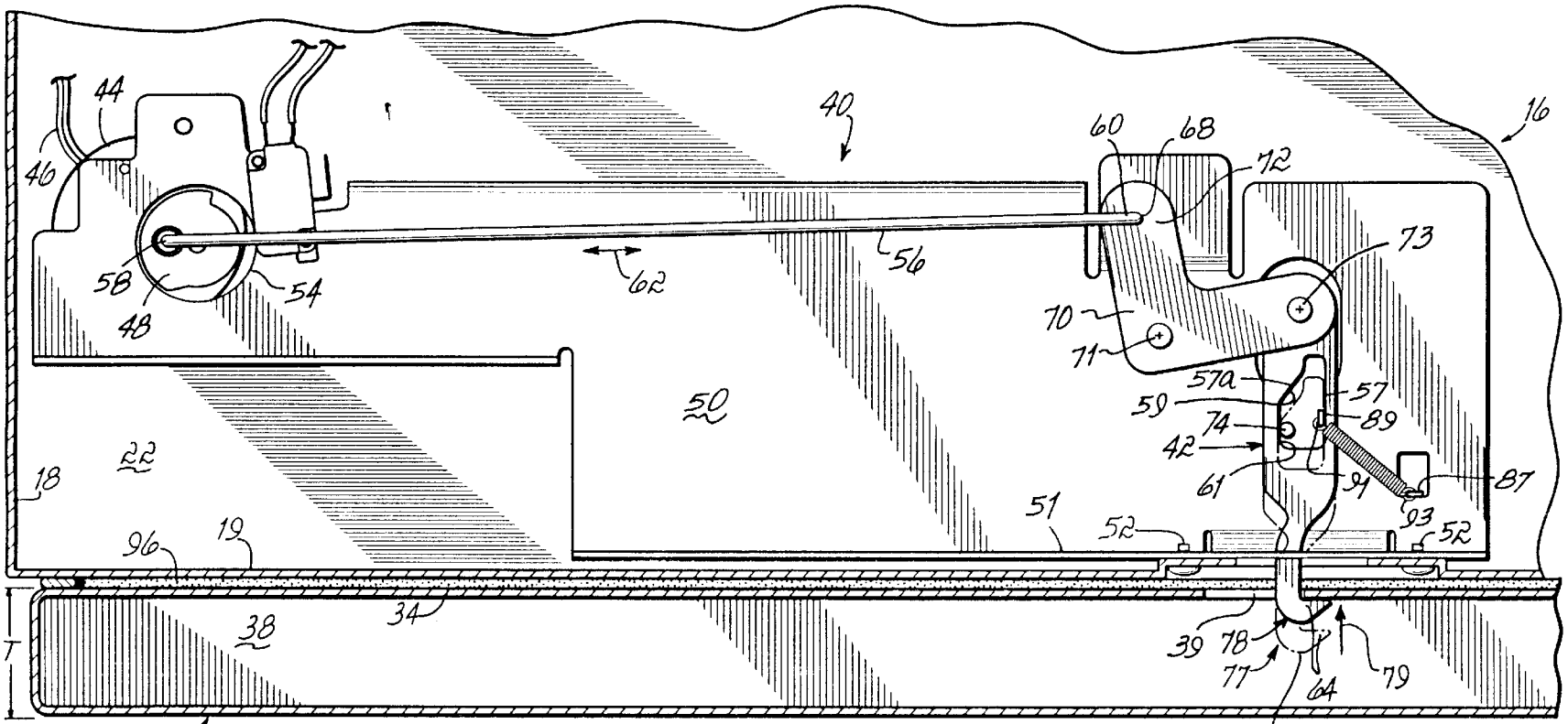
FIG. 4 is a top view illustrating the latch plate in a locked and sealed position.

As best illustrated in FIGS. 2–4, the door latch assembly 40 functions to lock the oven door 26 in a closed and sealed position so that the oven door 26 may not be opened e.g. when the oven is in a self-cleaning mode. The door latch assembly 40 comprises multiple components which work together to move a latch plate 42, best illustrated in FIG. 2, between three different positions so that the oven door may be opened when the latch plate is in a first position and the oven door may not be opened when the latch plate is in either its second or third positions (except with the use of a pry bar-type device or tool 43).

The door latch assembly 40 comprises a motor 44 activated by power lines 46 and located adjacent the oven cavity 24. One type of motor which has proven satisfactory is 120 volts AC; 60 Hz having a speed of 3.2 rpm. A cam 48 is secured to the motor 44 such that rotation of the motor causes the cam 48 to rotate about a vertical axis.

A mounting plate 50 extends generally from the left side of the range to the right side of the range and is secured to the front wall 19 of the range with fasteners 52 (see FIG. 2). In the embodiment illustrated in solid lines in FIG. 1, the mounting plate 50 is located below the top 21 of the range and above the top wall 22 of the oven cavity. An opening 54 in the mounting plate 50 (see FIG. 2) allows the cam 48 to freely rotate when activated by the motor 44. As illustrated in FIG. 2, the cam 48 is located above the mounting plate 50 and the motor 44 is located below the mounting plate 50. The mounting plate 50 is supported by the range body above the oven cavity 24 in a generally horizontal orientation as seen in FIGS. 1 and 2. Although FIG. 1 illustrates the mounting plate 50 being located in a particular orientation, the mounting plate 50 may be placed in other locations as well without departing from the spirit of the invention of this application.

As best illustrated in FIG. 2, the mounting plate 50 has a vertically oriented front lip 51. The front lip 51 abuts the front wall 19 of the range body and has a pair of holes 53 therein through which the fasteners 52 pass to secure the front lip 51 of the mounting plate 50 to the front wall 19 of the range body. Additionally, the front lip 51 of the mounting plate has a generally rectangular opening 55 through which the latch plate 42 passes.

As best illustrated in FIG. 2, an opening or guide 57 is located through the latch plate 42. The opening 57 is an opening of a particular configuration illustrated in detail in FIG. 2 comprising a generally triangular shaped rear portion **57*a* including a diagonal surface 59 and a generally square portion 57*b* having a stopping surface 61. The size and configuration of the opening 57 limits the movement of the latch plate 42** in a manner described in more detail below.

As best illustrated in FIGS. 2–4, a latch rod 56 extends between the cam 48 and a generally L-shaped link 70, extending generally from side to side of the range. The generally L-shaped link 70 is pivotally secured to the mounting plate 50 at location 71. The latch rod 56 has a first end 58 which is secured to the cam 48 and a second end 60 which is secured to the link 70 at location 72 in a manner which will be described in more detail below. The latch rod 56 is located generally above the mounting plate 50 and moves in a generally linear manner depicted by the arrows 62 (shown in FIGS. 3 and 4) as the cam 48 rotates.

Another component of the door latch assembly 40 is the latch plate 42 best illustrated in FIG. 2. The latch plate 42 has a hook 64 located at a front end 66, and is secured to L-shaped link 70 at 73. Between the front and back ends the opening 57 of the latch plate 42 is adapted to receive a pin 74. The pin 74 is secured to the mounting plate 50 and extends upwardly therefrom in a fixed location. The pin 74 remains inside the opening 57 as the latch plate 42 moves between positions. Alternatively, the pin may be secured to the latch plate and the opening formed in the mounting plate to restrict movement of the latch plate as the latch plate moves between positions.

As best illustrated in FIGS. 2–4, the latch plate 42 is movable between three positions: a first position illustrated in FIG. 3, a second position illustrated in FIG. 2 and a third position illustrated in FIG. 4 (in which the door is locked and sealed). The first position of the latch plate 42 is shown in dashed lines in FIG. 2 (to the left). In this first position, the hook 64 of the latch plate 42 is aligned with an opening 39 in the back wall 39 of the oven door (see FIG. 2). With the latch plate 42 in this first position, the oven door 26 may be freely opened, the hook 64 of the latch plate 42 passing through the opening 39 in the oven door 26. As the latch rod 56 translates rearwardly due to activation of the motor and consequent rotation of the cam 48, the latch plate 42 moves to its second position, which is shown in solid lines in FIG. 2. In this position, the oven door 26 may not be opened because the hook 64 of the latch plate 42 catches the back wall 34 of the oven door 26. Upon further rearward translation of the latch rod 56, the latch plate 42 is pulled rearwardly in the direction of arrow 79 to its third position (illustrated in FIG. 4) in which the oven door 26 is locked and sealed. In this position, the oven door 26 is correctly sealed and seated so as to provide a tight seal for the oven cleaning process.

As best illustrated in FIG. 2, the second end 60 of the latch rod 56 comprises a vertical section 80 and a horizontal section 82 which terminates in an end 83. The hole 68 in the link 70 is sized so as to have a diameter slightly larger than the diameter of the vertical section 80 of the latch rod 56 so that the vertical section 80 of the latch rod 56 passes through the hole 68 in the link 70, the horizontal section 82 of the latch rod 56 being located below the link 70.

In order to bias the latch plate 42 toward its second position, a biaser 85 (best illustrated in FIG. 2) extends between a bracket 87 fixedly secured to the front of the mounting plate 50 and a finger 89 of the latch plate 42. The finger 89 of the latch plate extends vertically and has a hole 90 therein through which a hook 91 of the biaser 85 passes in order to secure one end of the biaser 85 to the latch plate. The other end of the biaser 85 has a hook 93 which passes through a hole in the bracket 87. Although the biaser 85 is illustrated as being a spring, the biaser 85 may be any other biasing-type mechanism and may be secured at either end with structures other than hooks to the latch plate 42 and to the bracket 87, respectively.

In operation, upon activation of the motor, the cam 48 rotates, causing the latch rod 56 to translate along the direction of arrows 62. See FIGS. 3 and 4. Upon rearward translation of the latch rod 56, the latch plate 42 moves from its first position 76 to its second position 77 in which the oven door is prevented from opening (See FIGS. 3 AND 4). Upon further translation of the latch rod, the latch plate 42 is pulled rearwardly from its second position 76 to its third position 78 in the direction of arrow 79. The direction of arrow 79 and the direction of translation 62 of the latch rod 56 define an angle therebetween which is generally orthogonal. Depending upon the orientation of the latch rod 56, generally L-shaped link 70 and latch plate 42, this angle may be any angle, preferably greater than 30 degrees. When the latch plate 42 is in its third position 78 the oven door 26 is in a locked and sealed position with the back wall 34 of the oven door exerting pressure against a gasket 96 located between the oven door 26 and the front wall 19 of the range body (see FIG. 2).

In the event of an electrical or mechanical failure while the oven is in a self-cleaning mode and the oven door 26 is in a locked and sealed position, the latch rod 56 will not translate. Thus, the latch plate 42 is fixed in its third position 78. In heretofore known range door assemblies, a service technician had to be called in order to access the latch rod 56 through the back of the range in order to open the oven door 26 so that the oven could be used for cooking. With the present invention, a pry bar-type device or tool 43 having a horizontal section 98 and a vertical section 100 may be used to open the oven door 26 without having to call a service technician and/or without having to access the oven cavity through the rear panel of the range.

As best illustrated in FIG. 2, the vertical section 100 of the pry bar tool 43 is moved in the direction of arrow 102 such that the vertical section 100 is pried between the oven door 26 and the front wall 19 of the range body to the right of the latch plate. By moving the tool 43 in the direction of arrow 104, as shown in FIG. 2, pressure is exerted on the latch plate 42, pushing the front end of the latch plate in the direction of arrow 106 (to the left), as seen in FIG. 2, towards its first position. By moving the pry bar tool 43 in this direction, the latch plate 42 is moved against the bias of the biaser 85 causing the rear of the latch plate 42 to move in a forward and sideways direction as dictated by the configuration of the guide 57 formed in the mounting plate 50. With the latch plate 42 in its first position 76, the oven door 26 may be opened.

Thus, with the present invention an operator may quickly and easily open the oven door even in the event of a mechanical or electrical failure. Consequently, the oven may be used for cooking immediately and is not inoperable for an extended period of time until a service technician comes to fix the cause of the failure.

While we have described one preferred embodiment of the present invention, persons skilled in the art will appreciate changes and modifications which may be made to the present invention without departing from the scope of the invention. Therefore, we do not intend to be limited except by the scope of the following claims.

We claim:

1. A motorized door latch assembly for locking an oven door in a closed position closing an oven cavity, said oven door being mounted on a range body and being movable between an open and said closed position, said door latch assembly comprising:

a motor, a drive member connected to said motor at a first end and an L-shaped link at a second end, wherein the motor causes translation of said drive member in a first direction, a latch plate having a hook at an end thereof, said hook being adapted to engage said oven door, said latch plate being movable through actuation by said drive member between a first position in which said oven door may be opened, a second position in which said oven door may not be opened, and a third position in which said hook is translated along a second direction relative to said second position to pull in said oven door toward said oven cavity, wherein said first and second directions are substantially nonparallel.

2. The motorized door latch of claim 1 wherein said first and second directions are substantially orthogonal.

3. The motorized door latch of claim 1 wherein said first and second directions form an angle of greater than 30 degrees.

4. The motorized door latch of claim 1 wherein said first and second directions form an angle of greater than 45 degrees.

5. The motorized door latch of claim 1 wherein said first and second directions form an angle of greater than 60 degrees.

6. The motorized door latch of claim 1 wherein said drive member comprises a latch rod.

7. The motorized door latch of claim 1 further comprising a mounting plate mounted to said oven body, having a pin extending upwardly therefrom, said pin extending through an opening in said latch plate to restrict movement of said latch plate.

8. The motorized door latch of claim 7, further comprising a biaser extending between a fixed point on said mounting plate and said latch plate so as to bias said latch plate toward said second or third position.

9. The motorized door latch assembly of claim 1 wherein said hook extends through a mounting surface of said range body.

10. The motorized door latch assembly of claim 6 wherein said latch rod extends in a direction generally from side to side of said range.

11. A motorized door latch assembly for locking an oven door in a closed position, said oven door being mounted on a range body and being movable between an open and closed position, said door latch assembly comprising:

a mounting plate supportable by said range body above an oven cavity, said mounting plate having a pin extending upwardly from said mounting plate, a cam rotatably driven by a motor, said cam and motor being located beside said oven cavity, a latch rod secured to said cam at a first end and secured to an L-shaped link at a second end, said L-shaped link being pivotally secured to said mounting plate, a latch plate pivotally secured to said L-shaped link, said latch plate having a hook at an outer end and being movable between a first position in which said oven door may be opened and a second position in which said hook of said latch plate engages said oven door preventing said oven door from opening, a biaser extending between a fixed point on said mounting plate and said latch plate, said biaser urging said latch plate towards said second position, wherein upon rotation of said cam by said motor, said latch rod translates, moving said latch plate between said positions, said pin extending through an opening in said latch plate to restrict movement of said latch plate as said latch plate moves between said first and second positions.

12. The motorized door latch assembly of claim 11 wherein said latch plate may be moved from said second position to said first position without translation of said latch rod by applying pressure upon said hook of said latch plate against bias created by said biaser.

13. The motorized door latch assembly of claim 11 wherein said biaser is a spring.

14. A motorized door latch assembly for locking an oven door in a closed position so as to close an oven cavity for purposes of cleaning said oven cavity, said oven door being mounted on a range body, said door latch assembly comprising:

a mounting plate supportable by said range body above said oven cavity, a pin extending upwardly from said mounting plate, a motor mounted to said mounting plate and located on one side of said oven cavity, a cam rotatably driven by said motor, a latch rod extending generally from side to side of said range body above said oven cavity, said latch rod being secured to said cam at one end and secured to a latch plate at the other end, said latch plate having a hook at one end for engaging said oven door, a biaser extending between a fixed point on said mounting plate and said latch plate, and wherein upon rotation of said cam by said motor, said latch rod translates, moving said latch plate between a second position in which said hook of said latch plate engages said oven door preventing said oven door from opening and a first position in which said oven door may be opened, said pin extending through an opening in said latch plate to restrict movement of said latch plate as said latch plate moves between said first and second positions, said latch plate being movable from said second position to said first position so said oven door may be opened without translation of said latch rod.

15. A motorized door latch assembly for locking an oven door in a closed position closing an oven cavity, said oven door being mounted on a range body and being movable between an open and said closed position, said door latch assembly comprising:

a driver, a drive member connected to said driver, the driver causing translation of said drive member in a first direction, an L-shaped link secured to said drive member, a latch member secured to said L-shaped link, said latch member having a hook at an end thereof, said hook being adapted to engage said oven door, said latch plate being movable through actuation by said drive member between a first position in which said oven door may be opened, a second position in which said oven door may not be opened, and a third position in which said hook is translated along a second direction relative to said second position to pull in said oven door toward said oven cavity, wherein said first and second directions are substantially nonparallel.

16. The motorized door latch assembly of claim 15 wherein said driver is a motor.

17. The motorized door latch assembly of claim 15 wherein said drive member is substantially horizontally oriented.

18. The motorized door latch assembly of claim 15 wherein said drive member is substantially vertically oriented.

19. A motorized door latch assembly for locking an oven door in a closed position, said oven door being mounted on a range body and being movable between an open and closed position, said door latch assembly comprising:

a mounting plate supportable by said range body, a driver located beside said oven cavity, a latch rod operatively coupled to said driver at a first end and secured to an L-shaped link at a second end, said L-shaped link being pivotally secured to said mounting plate, a latch plate secured to said L-shaped link, said latch plate having a hook at an outer end and being movable between a first position in which said oven door may be opened and a second position in which said hook of said latch plate engages said oven door preventing said oven door from opening, a biaser extending between a fixed point on said mounting plate and said latch plate, said biaser urging said latch plate towards said second position, wherein upon translation of said latch rod, said latch plate moves between said positions, one of said mounting plate and said latch plate having a pin extending through an opening in the other of said mounting plate and said latch plate to restrict movement of said latch plate as said latch plate moves between said first and second positions.

20. The motorized door latch assembly of claim 19 wherein said latch plate engages one side of said oven door when said latch plate is in said second position.

* * * * *